United States Patent [19]

Senter

[11] Patent Number: 5,070,581

[45] Date of Patent: Dec. 10, 1991

[54] PROTECTIVE DEVICE FOR BILLFOLDS AND WALLETS

[76] Inventor: John H. Senter, 11271 Dona Lola Dr., Studio City, Calif. 91604

[21] Appl. No.: 422,736

[22] Filed: Oct. 17, 1989

[51] Int. Cl.[5] ..... A44B 21/00

[52] U.S. Cl. ..... 24/3 J; 24/3 M; 24/299; 224/269

[58] Field of Search ..... 24/3 R, 3 H, 3 M, 3 K, 24/3 L, 3 J, 3 C, 3 A, 298–302; 150/101, 102, 133, 134, 137; 119/106, 96; 224/253, 269, 252, 250

[56] References Cited

U.S. PATENT DOCUMENTS

| | | | |
|---|---|---|---|
| 836,693 | 11/1906 | Marshall | 150/102 |
| 2,042,808 | 6/1936 | Seebeck | 24/3 M |
| 2,138,978 | 12/1938 | Meme | 224/252 |
| 2,522,719 | 9/1950 | Johnson | 224/250 X |
| 2,689,957 | 9/1954 | Fulton . | |
| 2,760,539 | 8/1956 | Lavin . | |
| 2,779,523 | 1/1957 | Klimkiewicz | 150/102 X |
| 3,275,205 | 9/1966 | Howd et al. | 224/250 X |
| 3,422,498 | 1/1969 | Carlson . | |
| 3,672,005 | 6/1972 | Barber | 24/300 |
| 3,822,446 | 7/1974 | Silverstein | 150/134 X |
| 4,237,583 | 12/1980 | Sullivan . | |
| 4,830,244 | 5/1989 | Brannon | 224/269 X |

FOREIGN PATENT DOCUMENTS

| | | | |
|---|---|---|---|
| 875260 | 4/1953 | Fed. Rep. of Germany | 24/3 R |
| 2213610 | 9/1973 | Fed. Rep. of Germany | 150/134 |
| 624625 | 6/1949 | United Kingdom | 119/106 |

*Primary Examiner*—James R. Brittain

[57] ABSTRACT

A security device comprising a close-link chain with a lock ring permanently joined to one end for the formation of a bridle in which the centerfold of a billfold or wallet is confined. The other end of the chain is permanently joined to a second lock ring of greater diameter which is removably connected to a detachable spring clip with a t-bar guard for fastening the device to the waist-band of slacks or skirts without belt loops or the breast pocket of jackets. When applying the device to slacks or skirts with belts loops and a belt, which would interfere with the application and funtion of the spring clip with t-bar guard, the user separates the detachable clip from the second lock ring thereby allowing for the combinative formation of a first bridle with the belt loop, first and second lock rings, and a measure of close-link chain to secure the device to these kinds of clothing. The device is lightweight, easy to apply and use, inconspicuous to wear, will not deface a billfold or wearing apparel, and allows the users easy access to their billfolds or wallets with a predetermined limit of movement required for practical usage.

2 Claims, 3 Drawing Sheets

PROTECTIVE DEVICE FOR BILLFOLDS AND WALLETS

BACKGROUND

1. Field of Invention

This invention relates to protective devices for billfolds and wallets, specifically to a device for securing a billfold or wallet from accidentally slipping from the owner's pocket or by unauthorized removal.

2. Description of Prior Art

Most people who travel or attend public gatherings such as sporting events, shows, or conventions are concerned about the accidental loss or unauthorized removal of their billfold or wallet from their pocket. Many rely on the button on their hip pocket to deter loss or theft. Such button can be easily undone, neglected to be fastened by the user, or easily removed by the act of cutting the threads securing it. It is an inadequate safeguard for their billfold.

The prior art for the safeguarding of billfolds and wallets can be found in carriers, special safety wallets, or safety devices to fit into a user's billfold or wallet. The 'carriers' are worn by the users or applied to their wearing apparel and require the transfer of valuables or money, as with the money belt, or they can actually carry the billfold itself as with the security pouch. The disadvantages to the users include restricted access to their money or cards, and the 'carriers' are often bulky and uncomfortable to wear. The 'special safety wallets' also require the transfer of the user's money, cards, etc. to the 'special safety wallet'. Many of these wallets have a rough exterior surface utilizing a friction material or a magnet which is secured to the user's wearing apparel with a device that is pinned to the pocket resulting in a damaging effect on the user's clothing. The many 'safety devices' which must be forced into a billfold's storage compartment include the planar type or the spring and wire expander type. These 'safety devices' occupy the limited carrying space of the average billfold's compartments thereby reducing the amount of money or valuables it can store for usage. Other types of 'safety devices' are secured to the billfold by a pin that pierces its side wall or a clip which clamps onto its edge. In either case the billfold is defaced. These devices are often tedious to apply and can be damaging to both the user's billfold and clothing. Most are basically designed for use on men's clothing which have hip pocket buttons or belts, and would not be adaptable to women's wearing apparel such as a skirt or slacks without belt loops and having side pockets only.

Most users, therefore, would find it desirable to have a safeguard device for their billfold or wallet that is both easy to apply and comfortable to wear in an inconspicuous manner affording easy access for usage and avoiding damage to their billfolds or clothing.

OBJECTS AND ADVANTAGES

Accordingly, several objects and advantages of my invention are: to provide a protective device for usage with men's or women's clothing which precludes the accidental slipping of a billfold or wallet from the user's pocket; to provide such device which obstructs the unauthorized removal of such billfold or wallet from such pocket; to provide such device which can be worn inconspicuously, is light in weight and has adequate strength, without bulk, making it comfortable to wear; to provide such device which is adaptable to the various shapes, bulk, and materials of the many different types of billfolds and wallets available to the user; to provide such device which is adaptable to the different types of clothing available to the user, and to provide such device which can function as a safeguard to the user's billfold or wallet without the need of having to procure a special billfold or wallet or having to wear special clothing.

Further objects and advantages of my invention will become apparent from a consideration of the accompanying drawings and the ensuing description of it.

DRAWING FIGURES

DRAWING REFERENCE NUMERALS

Figure 1:
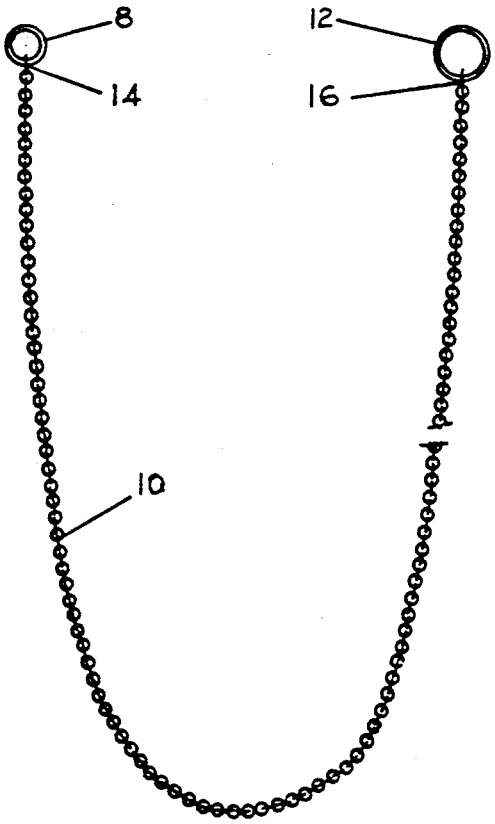
FIG. 1 is an over-all view of the protective device which shows the detachable spring clip with t-bar guard, removed.

8 first annulus
10 elongated flexible member
12 second annulus
14 end link
16 to other end link
18 user's wearing apparel with belt loops
20 belt loop waist-band
22 side belt loop
24 hip pocket
26 first bridle
28 bridle
30 user's billfold
32 billfold centerfold
34 user's wearing apparel without belt loops
36 waist-band
38 detachable spring clip with t-bar guard
40 bent body bar
42 clevis
44 spring pin
46 wire spring
48 clasp
50 t-bar guard
52 excess elongated flexible member
54 breast pocket wallet
56 breast pocket
58 user's jacket

PROTECTIVE DEVICE—DESCRIPTION

FIG. 1 shows an over-all view of the protective device with detachable spring clip with t-bar guard, removed. The device comprising an elongated flexible member 10 of sufficient length and strength which has a first keeper 8 secured to ligament 10 through end link 14 and a second annulus 12 secured to elongated flexible member 10 through other end link 16.

Elongated flexible member 10 is a close-link metal chain 460 mm long and of sufficient strength to sustain the working load of the weight of a full billfold, 170 to 225 grams, with an added safety factor for sudden tugs or strains. The link stock diameter of 1.0 mm has a width of 3.0 mm and a 2.5 mm pitch.

First annulus 8 is made of 17 gage steel wire formed into a crimped lock ring measuring 9.0 mm outside diameter.

Second annulus 12 is made of 16 gage steel wire formed into a double-bond, crimped lock ring measuring 16.0 mm outside diameter.

PROTECTIVE DEVICE—OPERATION

The protective device of FIG. 1 will perform the safeguard function upon the formation of first bridle 26 and bridle 28 by the user and the insertion of user's billfold 30 into bridle 28.

Figure 2:
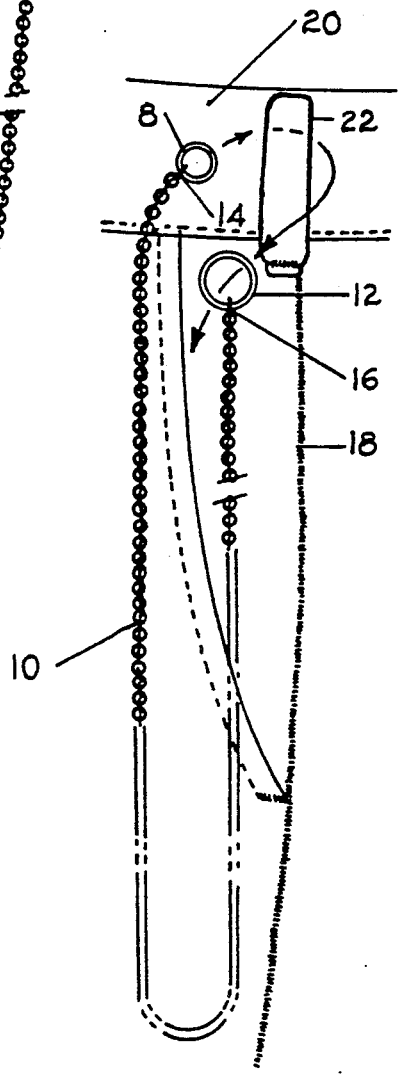
FIG. 2 illustrates the forming of the first bridle.

FIG. 2 illustrates forming of first bridle 26 by introducing first keeper 8 through side belt loop 22, then through second annulus 12, pulling elongated flexible member 10 taut (FIG. 3) thereby securing the device to user's wearing apparel with belt loops 18.

Figure 3:
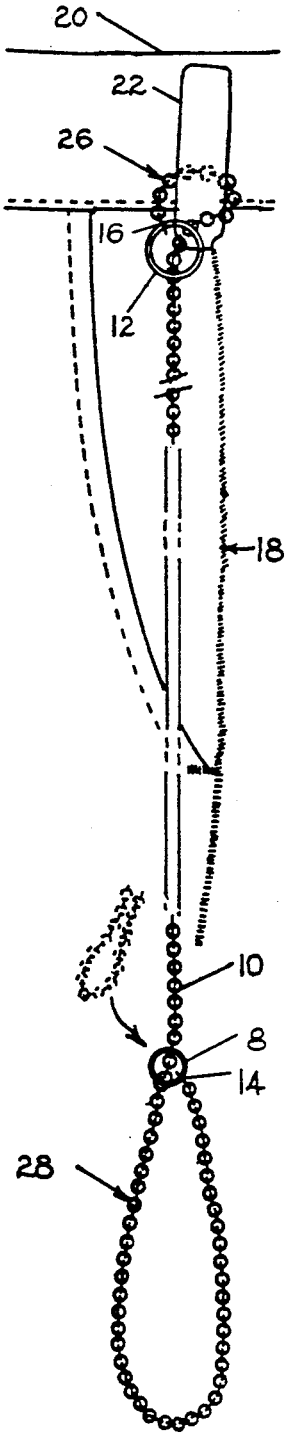
FIG. 3 shows such first bridle and a bridle.
Figure 4:
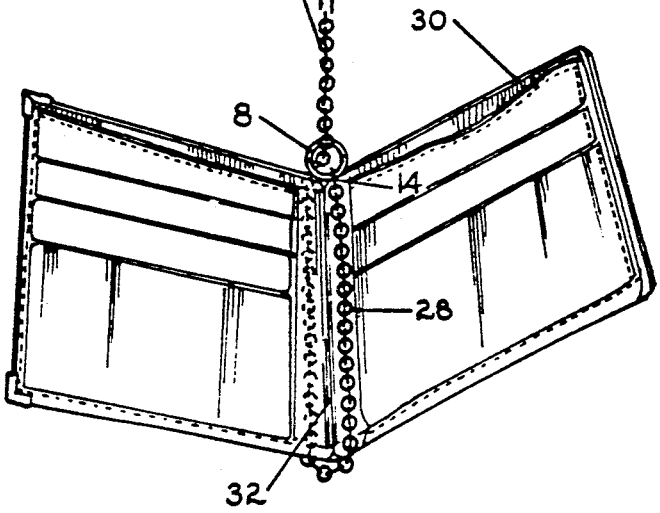
FIG. 4 shows a view of a billfold secured by such a bridle.

Forming of bridle 28 by introducing a double measure of elongated flexible member 19 through first annulus 8, as shown in FIG. 3, then introducing user's billfold 30 into bridle 28 and positioning bridle 28 around billfold centerfold 32 of user's billfold 30, (FIG. 4), thereby securing the device to user's billfold 30.

Figure 5:
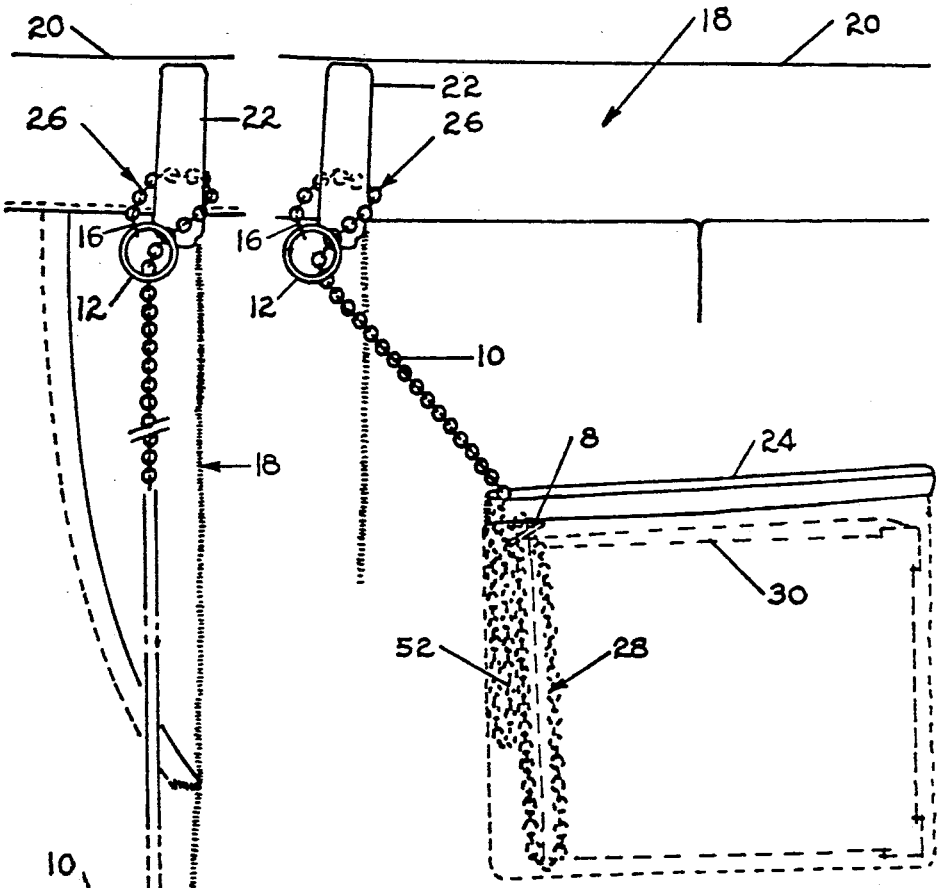
FIG. 5 shows a view of such three-piece device secured to side belt loop of user's wearing apparel with user's billfold in hip pocket of user's wearing apparel.

The placing of user's billfold 30 in hip pocket 24 of user's wearing apparel with belt loops 18 puts the protective device into use, shown in FIG. 5. Excess elongated flexible member 52 is stored in hip pocket 24.

While I have described in detail the sequential process of applying the protective device of the invention, in practice I have found that it can easily be applied by the user in thirty seconds or less.

PROTECTIVE DEVICE WITH DETACHABLE SPRING CLIP WITH T-BAR GUARD—DESCRIPTION

Figure 6:
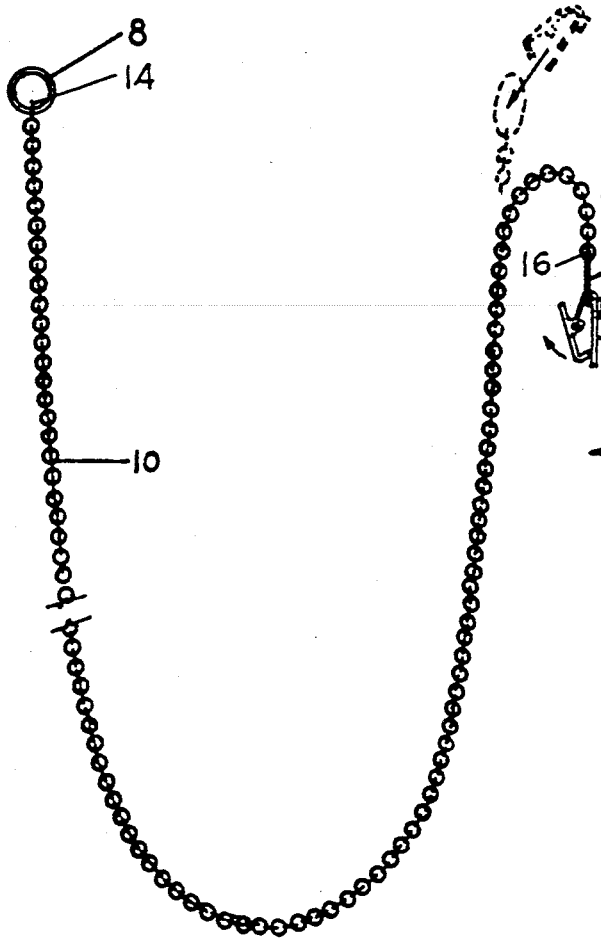
FIG. 6 shows an over-all view of the invention including the detachable spring clip with t-bar guard.

FIG. 6 shows an over-all view of a protective device with a detachable spring clip with t-bar guard 38.

Figure 8:
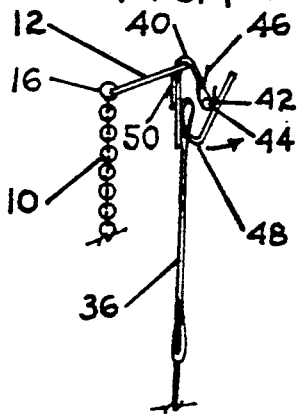
FIG. 8 is a full size section illustrating the t-bar guard function.

Such detachable spring clip with t-bar guard 38 comprises a bent body bar 40, 1.0 mm thick by 6.0 mm wide by 25.0 mm long with a clevis 42 to house a spring pin 44 and wire spring 46. The one-piece clasp 42 has bent hinges to receive the clevis 42, spring pin 44, and wire spring 46. One end of the clasp 42 is formed in a half-circle while the opposite end is bent forming a 3.5 mm serrated jaw. A t-bar guard 50, 1.0 mm thick by 4.0 mm wide by 12.0 mm long is joined to the bent body bar 40 of the clip (FIG. 8).

PROTECTIVE DEVICE WITH DETACHABLE SPRING CLIP WITH T-BAR GUARD—OPERATION

Figure 7:
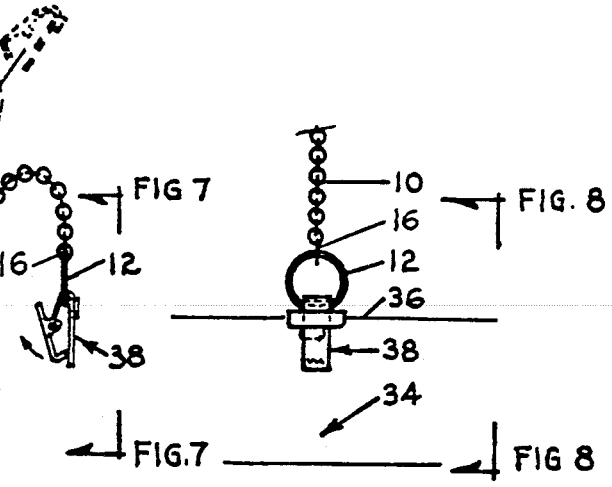
FIG. 7 shows a view of such detachable spring clip with t-bar guard clamped onto waist-band of user's wearing apparel.
Figure 9:
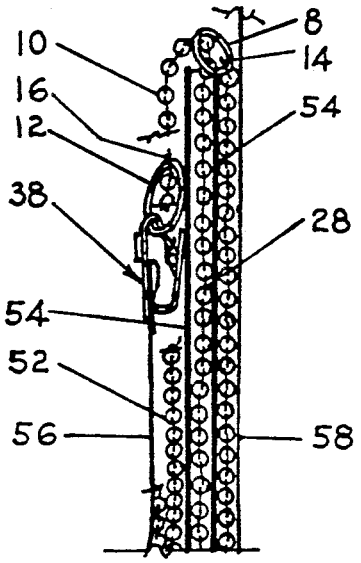
FIG. 9 shows a full size section of such detachable spring clip with t-bar guard clamped onto breast pocket of user's jacket.

The device with detachable spring clip with t-bar guard of FIG. 6 will perform the safeguard function after the user clamps said detachable spring clip with t-bar guard onto the waist-band 36 of user's wearing apparel without belt loops 34 (FIG. 7) and secures user's billfold 30 to bridle 28 (FIG. 4) or upon clamping of such detachable spring clip with t-bar guard onto the breast pocket 56 of user's jacket 58 as shown in FIG. 9.

Thus the reader will see that the combinative use of a bridle with the detachable spring clip with t-bar guard, and a first bridle with a bridle, makes the protective device of the invention able to provide its users with a safeguard for their billfold or wallet which is comfortable to wear, inconspicuous, easy to apply and use, adaptable to the wide varieties and shapes of billfolds and wallets of their choice and equally adaptable to the variety of both men's and women's clothing without the concern of damaging either. While the above descriptions contain many specificities, the reader should not construe these as limitations on the scope of the invention, but merely as exemplifications of preferred embodiments thereof. For example, skilled artisans will readily be able to change the dimensions, geometric shapes, and materials of the various elements and embodiments. The first and second annuli can be triangular in shape, hexagonal, or other forms, as long as the first annulus can be passed through the second annulus. Accordingly the reader is requested to determine the scope of the invention by the appended claims and their legal equivalents.

I claim:

1. A protective device for specifically retaining with allowance for practical usage a user's billfold or wallet within a range of movement relative to the user's wearing apparel said protective device comprising:

an elongated flexible member of sufficient length and strength having one end with a first annulus thereon and another end with a second annulus of greater diameter than the first annulus, which combination defines a means for forming a removeably connected bridle which consists of a double linear measure of said elongated flexible member of sufficient amount to receive a centerfold of the user's billfold disposed within the confines of the bridle which is pulled taut around the centerfold for preventing the billfold from disengaging from said elongated flexible member:

a detachable spring clip with t-bar guard includes a U-shaped bent body bar with a clevis formed on one end to support a spring pin mounted transversely in said clevis and said spring pin supporting a wire spring which has one end bearing upon a body of a clasp, said wire spring being of sufficient strength to activate the holding power of said clasp which includes two bent tabs formed at right angles on either side of said clasp with a bore formed in said two bent tabs to pivotally support said spring pin, one end of said clasp extends beyond said two bent tabs and another end is bent to form a serrated jaw, a t-bar guard which includes a bar of greater length than the inside diameter of said second annulus is joined transversely to said U-shaped bent body bar so as to contact an end of said U-shaped bent body bar on the other side of said U-shaped body bar opposite said clevis; said second annulus supported transversely within a U-shaped portion of said U-shaped bent both bar with said t-bar guard preventing said second annulus from disengaging from said detachable spring clip due to the greater length of said t-bar guard than the diameter of said second annulus when said spring clip is clamped onto the user's wearing apparel whereby the protective device secures the user's billfold to the user's wearing apparel obstructing the unintentional separation of the user's billfold from the user's wearing apparel.

2. The device as recited in claim 1 wherein said elongated flexible member is a light-weight close-link chain having two end links with orifices said first annulus is a crimped first lock ring, said second annulus is a double-band crimped second lock ring of greater diameter than said first lock ring, the two end link orifices of said close-link chain are of sufficient size to admit said first and second lock rings for attaching thereon to said close-link chain.

* * * * *